US009324331B2

(12) United States Patent
Yamanashi et al.

(10) Patent No.: US 9,324,331 B2
(45) Date of Patent: Apr. 26, 2016

(54) CODING DEVICE, COMMUNICATION PROCESSING DEVICE, AND CODING METHOD

(75) Inventors: Tomofumi Yamanashi, Kanagawa (JP); Toshiyuki Morii, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 265 days.

(21) Appl. No.: 13/993,851

(22) PCT Filed: Dec. 14, 2011

(86) PCT No.: PCT/JP2011/006981

§ 371 (c)(1),
(2), (4) Date: Jun. 13, 2013

(87) PCT Pub. No.: WO2012/095924

PCT Pub. Date: Jul. 19, 2012

(65) Prior Publication Data

US 2013/0339009 A1 Dec. 19, 2013

(30) Foreign Application Priority Data

Jan. 14, 2011 (JP) ..... 2011-006211
Mar. 14, 2011 (JP) ..... 2011-054919

(51) Int. Cl.
*G10L 19/12* (2013.01)
*G10L 19/00* (2013.01)
(Continued)

(52) U.S. Cl.
CPC ..... *G10L 19/12* (2013.01); *G10L 19/00* (2013.01); *G10L 25/06* (2013.01); *G10L 25/21* (2013.01)

(58) Field of Classification Search
CPC ..... G10L 19/04; G10L 19/06; G10L 25/00; G10L 19/0212
See application file for complete search history.

(56) References Cited

U.S. PATENT DOCUMENTS 5,173,941 A 12/1992 Yip et al.
5,179,594 A 1/1993 Yip et al.
(Continued)

FOREIGN PATENT DOCUMENTS

JP 03-236100 10/1991
JP 05-063580 3/1993
(Continued)

OTHER PUBLICATIONS

Extended European Search Report, dated Jun. 6, 2014, for corresponding European Application No. 11855814.7.
(Continued)

*Primary Examiner* — Richemond Dorvil
*Assistant Examiner* — Rodrigo Chavez
(74) *Attorney, Agent, or Firm* — Greenblum & Bernstein, P.L.C.

(57) ABSTRACT

Provided are a coding device, a communication processing device, and a coding method, whereby processing operation load (computational load) is significantly reduced for a configuration which computes either frame energy or sub-frame energy of an input signal, using auto-correlation operations, without causing a decline in the precision of either the frame energy or the sub-frame energy. In a coding device (101), a sub-frame energy computation unit (201) computes the sub-frame energy by substituting the sum of input signal auto-correlation operations in a first range with the sum of auto-correlation operations in a second range which differs at least partially from the first range.

8 Claims, 16 Drawing Sheets

(51) Int. Cl.
*G10L 25/21* (2013.01)
*G10L 25/06* (2013.01)

(56) References Cited

U.S. PATENT DOCUMENTS

| | | | | |
|---|---|---|---|---|
| 5,187,745 | A | 2/1993 | Yip et al. | |
| 5,265,190 | A | 11/1993 | Yip et al. | |
| 5,717,825 | A * | 2/1998 | Lamblin | G10L 19/107 704/200 |
| 5,924,062 | A | 7/1999 | Maung | |
| 6,047,254 | A * | 4/2000 | Ireton | G10L 19/08 704/207 |
| 8,396,716 | B2 * | 3/2013 | Qi | G10L 19/06 704/217 |
| 2003/0028373 | A1 | 2/2003 | Kandhadai et al. | |
| 2003/0046066 | A1 | 3/2003 | Kandhadai et al. | |
| 2004/0228502 | A1 * | 11/2004 | Bradley | G10L 19/018 382/100 |
| 2007/0136052 | A1 * | 6/2007 | Gao | G10L 19/20 704/207 |
| 2010/0169086 | A1 * | 7/2010 | Qi | G10L 19/008 704/219 |
| 2011/0004471 | A1 * | 1/2011 | Schandl | G10L 19/012 704/226 |
| 2011/0178795 | A1 * | 7/2011 | Bayer | G10L 19/002 704/205 |

FOREIGN PATENT DOCUMENTS

| | | |
|---|---|---|
| JP | 6-138896 | 5/1994 |
| JP | 08-030298 | 2/1996 |
| JP | 11-327599 | 11/1999 |
| JP | 2008-158312 | 7/2008 |
| WO | 02/099787 | 12/2002 |
| WO | 02/099788 | 12/2002 |

OTHER PUBLICATIONS

International Search Report, mailed Feb. 28, 2012, for International Application No. PCT/JP2011/006981.

* cited by examiner

FIG. 4

$$
\begin{array}{cc}
 & m \\
j & \begin{bmatrix}
\alpha_0\alpha_0 \cdot \sum_i x_{i-0}x_{i-0} & \alpha_0\alpha_1 \cdot \sum_i x_{i-0}x_{i-1} & \cdots & \alpha_0\alpha_{P-1} \cdot \sum_i x_{i-0}x_{i-(P-1)} \\
\alpha_1\alpha_0 \cdot \sum_i x_{i-1}x_{i-0} & \alpha_1\alpha_1 \cdot \sum_i x_{i-1}x_{i-1} & \cdots & \cdots \\
\cdots & \cdots & \cdots & \cdots \\
\alpha_{P-1}\alpha_0 \cdot \sum_i x_{i-(P-1)}x_{i-0} & \cdots & \cdots & \alpha_{P-1}\alpha_{P-1} \cdot \sum_i x_{i-(P-1)}x_{i-(P-1)}
\end{bmatrix}
\end{array}
$$

$$i = start_k, \cdots, end_k$$

$$k = 0, \ldots, N_S - 1$$

$$j = 0, \ldots, P - 1$$

FIG. 5

$$
\begin{array}{c}
m \\
j
\end{array}
\begin{bmatrix}
\sum_i x_{i-0} x_{i-0} & \sum_i x_{i-0} x_{i-1} & \cdots & \sum_i x_{i-0} x_{i-(P-1)} \\
\sum_i x_{i-1} x_{i-0} & \sum_i x_{i-1} x_{i-1} & \cdots & \\
\cdots & & & \cdots \\
\sum_i x_{i-(P-1)} x_{i-0} & \cdots & & \sum_i x_{i-(P-1)} x_{i-(P-1)}
\end{bmatrix}
$$

$$
\begin{aligned}
i &= start_k, \cdots, end_k \\
k &= 0, \cdots, N_S - 1 \\
j &= 0, \ldots, P - 1
\end{aligned}
$$

FIG. 6

$$
\begin{array}{cc}
 & m \\
j & \begin{bmatrix}
V(0,0) & V(0,1) & \cdots & V(0,P-1) \\
V(0,1) & V(1,1) & & \\
\vdots & & \ddots & \vdots \\
V(0,P-1) & \cdots & & V(P-1,P-1)
\end{bmatrix}
\end{array}
$$

CODING DEVICE, COMMUNICATION PROCESSING DEVICE, AND CODING METHOD

TECHNICAL FIELD

The present invention relates to a coding apparatus, a communication processing apparatus and a coding method used for a communication system that encodes and transmits a signal.

BACKGROUND ART

Compression coding techniques are often used when transmitting a speech/sound signal in a packet communication system represented by Internet communication or a mobile communication system or the like, to improve transmission efficiency of the speech/sound signal. In addition to simply encoding the speech/sound signal at a low bit rate, there is also a growing demand for a technique for encoding a wider band speech/sound signal and a technique for encoding/decoding with a low amount of processing calculation without causing degradation of sound quality.

Various techniques for satisfying such a demand are being developed to reduce the amount of processing calculation without causing quality degradation of a decoded signal. For example, according to a technique disclosed in Patent Literature (hereinafter, abbreviated as PTL) 1, a CELP (Code Excited Linear Prediction) type coding apparatus calculates energy of an inputted speech signal before a linear predictive analysis. According to PTL 1, a linear predictive analysis is performed only when the calculated energy is determined not to be 0, whereas a linear prediction coefficient according to a predetermined fixed pattern is outputted when the calculated energy is determined to be 0. This scheme can cut down on waste of performing a time-consuming linear predictive analysis and thereby shorten the processing time and also suppress current consumption accompanying the amount of processing calculation.

CITATION LIST

Patent Literature

PTL 1
Japanese Patent Application Laid-Open No. HEI 5-63580

SUMMARY OF INVENTION

Technical Problem

According to PTL 1 above, the coding apparatus first applies pre-processing such as removal of a DC component and removal of a low-frequency region to the inputted speech signal (hereinafter, referred to as "input signal"). Next, the coding apparatus calculates an auto-correlation of the input signal subjected to the pre-processing and calculates average frame energy (calculates $\phi(0, 0)$ and $\phi(10, 10)$ in the above-described Patent Literature) using this auto-correlation. PTL 1 then discloses a configuration of determining whether or not the above-described average frame energy is 0 and omitting subsequent linear predictive analysis processing when the average frame energy is 0.

However, the frame energy disclosed in PTL 1 above is only an average value and the accuracy thereof cannot be said to be sufficient. Furthermore, calculating accurate frame energy according to the method disclosed in the Patent Literature above requires 100 auto-correlation operations from $\phi(0, 0)$ to $\phi(10, 10)$, requiring an enormous amount of calculation.

It is an object of the present invention to provide a coding apparatus, a communication processing apparatus and a coding method that drastically reduce the amount of processing calculation (amount of calculation) in a configuration of calculating frame energy or subframe energy of an input signal using auto-correlation operations without causing degradation of the accuracy of frame energy or subframe energy.

Solution to Problem

A coding apparatus according to an aspect of the present invention includes: an energy calculation section that calculates one of frame energy and subframe energy of an input signal using an auto-correlation operation of the input signal; and a coding section that encodes the input signal using one of the frame energy and the subframe energy, and generates encoded information, in which the energy calculation section calculates one of the frame energy and the subframe energy by substituting the sum of auto-correlation operations in a first range of the input signal with the sum of auto-correlation operations in a second range which differs at least partially from the first range.

A coding apparatus according to an aspect of the present invention includes: an energy calculation section that calculates one of frame energy and subframe energy of an input signal using an auto-correlation operation of the input signal; and a coding section that encodes the input signal using one of the frame energy and the subframe energy, and generates encoded information, in which, when performing an auto-correlation operation on the input signal using equation 1 or equation 2, the energy calculation section performs auto-correlation operations at j' and m' which are different from j and m in accordance with the values of j and in, and calculates one of the frame energy and the subframe energy by substituting the auto-correlation operations at j and m with the auto-correlation operations at j' and m':

(Equation 1)

$$E_k = \sum_i A_i^2 = \sum_{j=0}^{P-1} \sum_{m=0}^{P-1} \alpha_j \alpha_m \sum_i x_{i-j} x_{i-m} \quad [1]$$

$$(i = start_k, \ldots, end_k \quad k = 0, \ldots, N_S - 1)$$

$E_k$: energy (subframe energy) of subframe whose subframe index is k $A_i$: input signal after filtering, P: filter order, $\alpha_j$, $\alpha_m$: filter coefficient, $x_n$: (n+1)-th input signal of subframe, j, m: index indicating delay time when auto-correlation is calculated, i: sample index of input signal, $N_s$: number of subframes, k: subframe index, $start_k$: leading sample index of subframe whose subframe index is k, and $end_k$: tail-end sample index of subframe whose subframe index is k; and (Equation 2)

$$E = \sum_i A_i^2 \quad [2]$$

$$= \sum_{j=0}^{P-1} \sum_{m=0}^{P-1} \alpha_j \alpha_m \sum_i x_{i-j} x_{i-m}$$

($i$ = start, … , end)

E: frame energy, $A_i$: input signal after filtering,

P: filter order, $\alpha_j$, $\alpha_m$: filter coefficient, $x_n$: (n+1)-th input signal of frame, j, m: index indicating delay time when auto-correlation is calculated, i: sample index of input signal, start: leading sample index of frame, and end: tail-end sample index of frame.

A communication processing apparatus according to an aspect of the present invention performs an auto-correlation operation of an input signal using a covariance matrix, the apparatus including: a grouping section that groups matrix elements of the covariance matrix into a plurality of groups; and an operation section that substitutes the sum of auto-correlation operations in first matrix elements with the sum of auto-correlation operations in second matrix elements grouped into the same group as that of the first matrix elements.

A coding method according to an aspect of the present invention includes: a calculating step of calculating one of frame energy and subframe energy of an input signal using an auto-correlation operations of the input signal; and an encoding step of encoding the input signal using one of the frame energy and the subframe energy, and generating encoded information, in which in the calculating step, one of the frame energy and the subframe energy is calculated by substituting the sum of auto-correlation operations in a first range of the input signal with the sum of auto-correlation operations in a second range which differs at least partially from the first range.

Advantageous Effects of Invention

According to the present invention, in a configuration of calculating frame energy or subframe energy of an input signal using auto-correlation operations, performing approximate auto-correlation operations makes it possible to drastically reduce the amount of processing calculation (amount of calculation) without causing deterioration of the accuracy of frame energy or subframe energy.

BRIEF DESCRIPTION OF DRAWINGS

FIG. 4 is a diagram illustrating an example of a matrix used to calculate subframe energy $E_k$;

FIG. 5 is a diagram illustrating an example of an auto-correlation matrix;

FIG. 6 is a diagram illustrating a matrix which is a simplified version of the auto-correlation matrix in FIG. 5;

DESCRIPTION OF EMBODIMENTS

Hereinafter, embodiments of the present invention will be described in detail with reference to the accompanying drawings. A coding apparatus and a decoding apparatus according to the present invention will be described by taking a speech coding apparatus and a speech decoding apparatus as an example. An input signal which will be used hereinafter is a generic term for a signal obtained by converting so-called sound to an electric signal such as speech signal, audio signal or a mixture of these signals.

Embodiment 1

Figure 1:
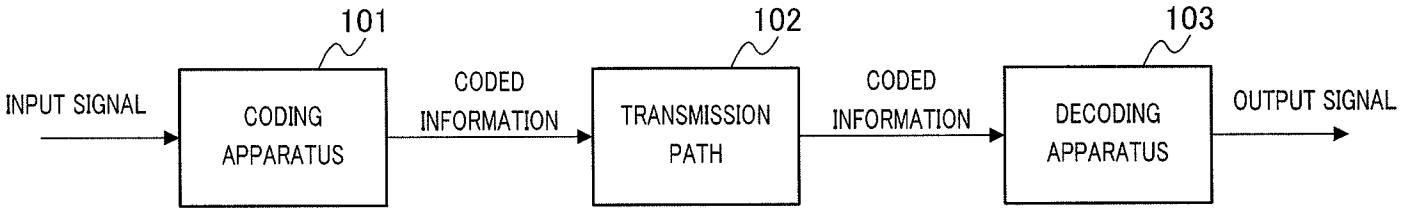
FIG. 1 is a block diagram illustrating a configuration of a communication system having a coding apparatus and a decoding apparatus according to Embodiment 1 of the present invention.

FIG. 1 is a block diagram illustrating a configuration of a communication system including a coding apparatus and a decoding apparatus according to an embodiment of the present invention. In FIG. 1, the communication system is provided with coding apparatus 101 and decoding apparatus 103, which are communicable with each other via transmission path 102. Both of coding apparatus 101 and decoding apparatus 103 are used while being normally mounted on a base station apparatus or communication terminal apparatus or the like. As in the case of PTL 1, the present embodiment will describe a configuration in which subsequent linear predictive analysis processing is omitted when subframe energy (frame energy) is 0. However, the present embodiment is different from PTL 1 in a method of calculating subframe energy (frame energy).

Coding apparatus 101 divides an input signal into blocks of N samples (N is a natural number) each and encodes the input signal in frame units, with one frame being composed of N samples. Here, let us suppose that the input signal to be encoded is expressed as $x_n$ (n=0, . . . , N−1). Symbol n represents an (n+1)-th signal element of the input signal divided into blocks of N samples. Coding apparatus 101 transmits encoded input information (encoded information) to decoding apparatus 103 via transmission path 102.

Decoding apparatus 103 receives the encoded information transmitted from coding apparatus 101 via transmission path 102, decodes the encoded information and obtains an output signal.

Figure 2:
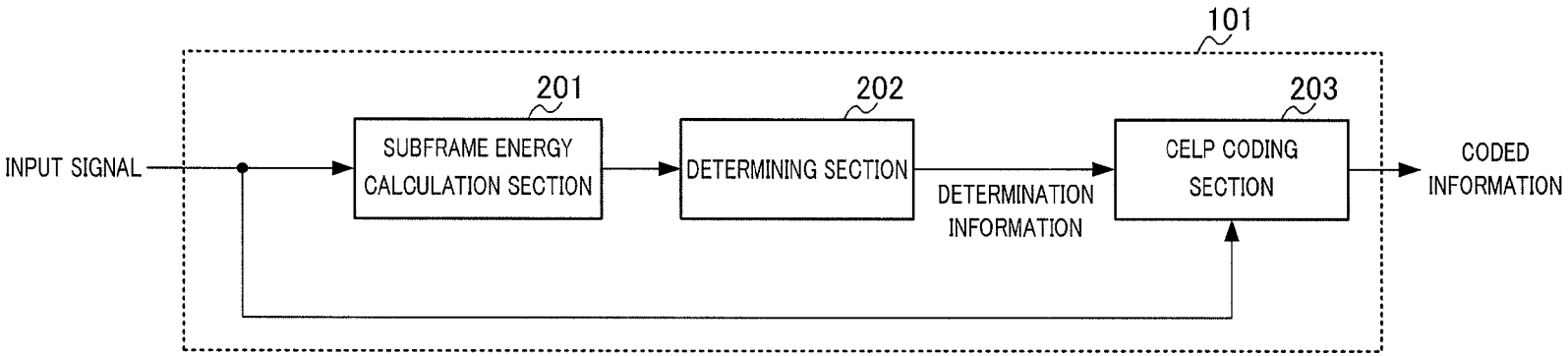
FIG. 2 is a block diagram illustrating a principal internal configuration of the coding apparatus according to Embodiment 1 shown in FIG. 1.

FIG. 2 is a block diagram illustrating an internal configuration of coding apparatus 101 shown in FIG. 1. Coding apparatus 101 is mainly constructed of subframe energy calculation section 201, determining section 202, and CELP coding section 203. It is assumed that subframe energy calculation section 201, determining section 202 and CELP coding section 203 perform processing in subframe units. Hereinafter, details of each process will be described.

Subframe energy calculation section 201 receives an input signal. Subframe energy calculation section 201 first divides the received input signal into subframes. Hereinafter, a configuration will be described in which input signal $x_n$ (n=0, . . . , N−1) is divided into, for example, $N_s$ subframes (subframe index k=0 to $N_s$−1).

Subframe energy calculation section 201 calculates subframe energy $E_k$ (k=0, . . . , $N_s$−1) for each divided subframe. Details of the method of calculating subframe energy will be described later. Subframe energy calculation section 201 outputs calculated subframe energy $E_k$ to determining section 202.

Determining section 202 receives subframe energy $E_k$ (k=0, . . . , $N_s$−1) from subframe energy calculation section 201. Determining section 202 determines whether or not subframe energy $E_k$ is 0 for each received subframe and outputs the determination result to CELP coding section 203 as determination information $I_k$ (k=0, . . . , $N_s$−1). Determining section 202 sets the value of determination information $I_k$ to 0 ($I_k$=0) when subframe energy $E_k$ is 0, or sets the value of determination information $I_k$ to 1 ($I_k$=1) when subframe energy $E_k$ is not 0. The above setting example is merely an example, and the present invention is similarly applicable to cases where determining section 202 sets the value to another value.

Next, determining section 202 outputs set determination information $I_k$ (k=0, . . . , $N_s$−1) to CELP coding section 203.

CELP coding section 203 receives the input signal and determination information $I_k$ (k=0, . . . , $N_s$−1) from determining section 202. CELP coding section 203 encodes the input signal using the inputted determination information. Details of the coding processing in CELP coding section 203 will be described later.

Next, the internal configuration of subframe energy calculation section 201 will be described.

Figure 3:
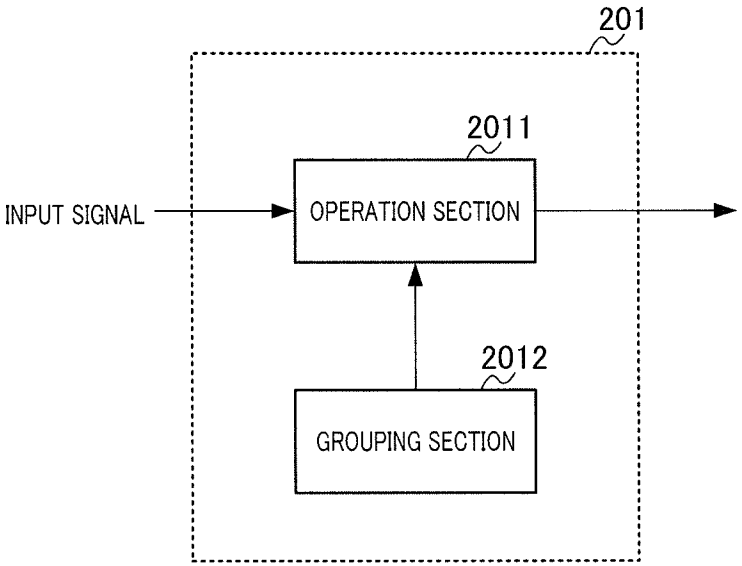
FIG. 3 is a block diagram illustrating a principal configuration of the subframe energy calculation section.

FIG. 3 is a diagram illustrating the internal configuration of subframe energy calculation section 201. Subframe energy calculation section 201 includes grouping section 2012, and operation section 2011.

A configuration will be described in the present embodiment as an example where operation section 2011 of subframe energy calculation section 201 collectively performs filtering processing and auto-correlation calculation on the input signal.

Grouping section 2012 is assumed to have information of order P of a filter coefficient beforehand. Grouping section 2012 then groups elements of an auto-correlation matrix into a plurality of groups according to variables j and in and outputs the grouping information to operation section 2011. The grouping method in grouping section 2012 will be described later.

Operation section 2011 calculates subframe energy based on the grouping information. In that case, operation section 2011 collectively performs filtering processing and auto-correlation calculation processing on the input signal. The method of calculating subframe energy in operation section 2011 will be described later.

Next, details of the method of calculating subframe energy $E_k$ in subframe energy calculation section 201 will be described.

Subframe energy calculation section 201 first calculates auto-correlation on input signal $x_i$ divided into subframes (i=$start_k$, . . . , $end_k$) and calculates subframe energy using this. Here, it is assumed that $start_k$ and $end_k$ indicate a leading sample index and a tail-end sample index, respectively, of a subframe whose subframe index is k.

First, a general configuration will be described in which subframe energy calculation section 201 simply performs filtering processing on an input signal and calculates auto-correlation on the input signal after filtering. Let us suppose that a filter coefficient at the time of filtering processing is $\alpha_j$ (j=0, . . . , P−1). The order of the filter coefficient at this time is P. Equation 3 shows filtering processing on input signal $x_n$. Let us suppose that the input signal after filtering is expressed as $A_i$ (i=$start_k$, . . . , $end_k$). The filtering processing here is not limited to filter types such as low pass filter, high pass filter and band pass filter.

(Equation 3)

$$A_i = \sum_{j=0}^{P-1} \alpha_j x_{i-j} \quad [3]$$

$$(i = start_k, \ldots, end_k \quad k = 0, \ldots, N_S - 1)$$

Next, subframe energy calculation section 201 calculates P-th order auto-correlation ϕ(j, in) on input signal $A_i$ after filtering obtained from equation 3. Here, subframe energy calculation section 201 obtains subframe energy $E_k$ of input signal $A_i$ subjected to filtering processing using a covariance according to equation 4 below.

(Equation 4)

$$\begin{aligned} E_k &= \sum_i A_i^2 \quad [4] \\ &= \sum_i \left\{ \sum_{j=0}^{P-1} \alpha_j x_{i-j} \right\}^2 \\ &= \sum_i \left( \sum_{j=0}^{P-1} \alpha_j x_{i-j} \right) \left( \sum_{m=0}^{P-1} \alpha_m x_{i-m} \right) \\ &= \sum_{j=0}^{P-1} \sum_{m=0}^{P-1} \alpha_j \alpha_m \sum_i x_{i-j} x_{i-m} \end{aligned}$$

$$(i = start_k, \ldots, end_k \quad k = 0, \ldots, N_S - 1)$$

Accurate subband energy can be calculated according to equation 4 above. However, in the simple configuration as described above, the respective auto-correlations need to be calculated in accordance with the values of j and m, which results in a problem that the amount of calculation becomes enormous.

Thus, subframe energy calculation section 201 of the present invention simplifies the operation in equation 4 above without causing deterioration of the accuracy, and thereby drastically reduces the amount of calculation. The present invention does not actually perform filtering processing on the input signal, but performs processing substantially equivalent to processing of calculating frame energy (subframe energy) of the input signal subjected to filtering processing, that is, approximate calculation processing. For this reason, suppose that coefficients of filtering processing are used. That is, according to the present invention, the filtering processing itself in the above simple configuration is also included in the method of calculating frame energy (subframe energy) which will be described later. As in the case of the filtering processing in the above simple configuration, without being limited to the filter types such as low pass filter, high pass filter, and band pass filter, the present invention is likewise applicable to various types of filter processing. The method of calculating subframe energy in subframe energy calculation section 201 of the present invention will be described in detail below.

Equation 4 above can be modified as equation 5 below. When equation 5 is divided in accordance with the respective values of i, j and m, equation 5 can be expressed as the sum of elements of a matrix in FIG. 4 (matrix elements).

(Equation 5)

$$
\begin{aligned}
E_k &= \sum_i A_i^2 \qquad [5] \\
&= \sum_{j=0}^{P-1}\sum_{m=0}^{P-1} \alpha_j\alpha_m \sum_i x_{i-j}x_{i-m} \\
&= \alpha_0\alpha_0\sum_i x_i x_i + \alpha_0\alpha_1\sum_i x_i x_{i-1} + \ldots + \\
&\quad \alpha_0\alpha_{P-1}\sum_i x_i x_{i-(P-1)} + \alpha_1\alpha_0\sum_i x_{i-1}x_i + \\
&\quad \alpha_1\alpha_1\sum_i x_{i-1}x_{i-1} + \ldots + \alpha_1\alpha_{P-1}\sum_i x_{i-1}x_{i-(P-1)} \\
&\quad \vdots + \\
&\quad \alpha_{P-1}\alpha_0\sum_i x_{i-(P-1)}x_i + \alpha_{P-1}\alpha_1\sum_i x_{i-(P-1)}x_{i-1} + \ldots + \\
&\quad \alpha_{P-1}\alpha_{P-1}\sum_i x_{i-(P-1)}x_{i-(P-1)}
\end{aligned}
$$

$$(i = start_k, \ldots, end_k \quad k = 0, \ldots, N_S - 1)$$

Here, in equation 5, the portion of filter coefficient $\alpha_j\alpha_m$ of each term is independent of i and $\alpha_j\alpha_m$ is a predetermined filter coefficient, and therefore $\alpha_j\alpha_m$ need not be calculated for each frame process. Therefore, the portion that needs to be calculated for each frame process is the portion of $\Sigma x_{i-j}x_{i-m}$ of each term in equation 5 and this portion needs to be calculated for each of i, j and m. Here, the calculation expression of the portion of $\Sigma x_{i-j}x_{i-m}$ only can be expressed as the sum of a matrix in FIG. 5 (hereinafter, referred to as "auto-correlation matrix"). The auto-correlation matrix in FIG. 5 has a format in which filter coefficient $\alpha_j\alpha_m$ is omitted from the matrix in FIG. 4.

In the auto-correlation matrix in FIG. 5, the value of the auto-correlation remains the same even if the values of j and in are switched around, and therefore the values of the respective elements can be expressed as equation 6 below in accordance with the combination of values of j and m. Here, using equation 6, the auto-correlation matrix in FIG. 5 can be further simplified as shown in FIG. 6.

(Equation 6)

$$
\begin{aligned}
V(j, m) &= V(m, j) \qquad [6] \\
&= \sum_i x_{i-j}x_{i-m}
\end{aligned}
$$

$$(i = start_k, \ldots, end_k \quad k = 0, \ldots, N_S - 1)$$

Figure 7:
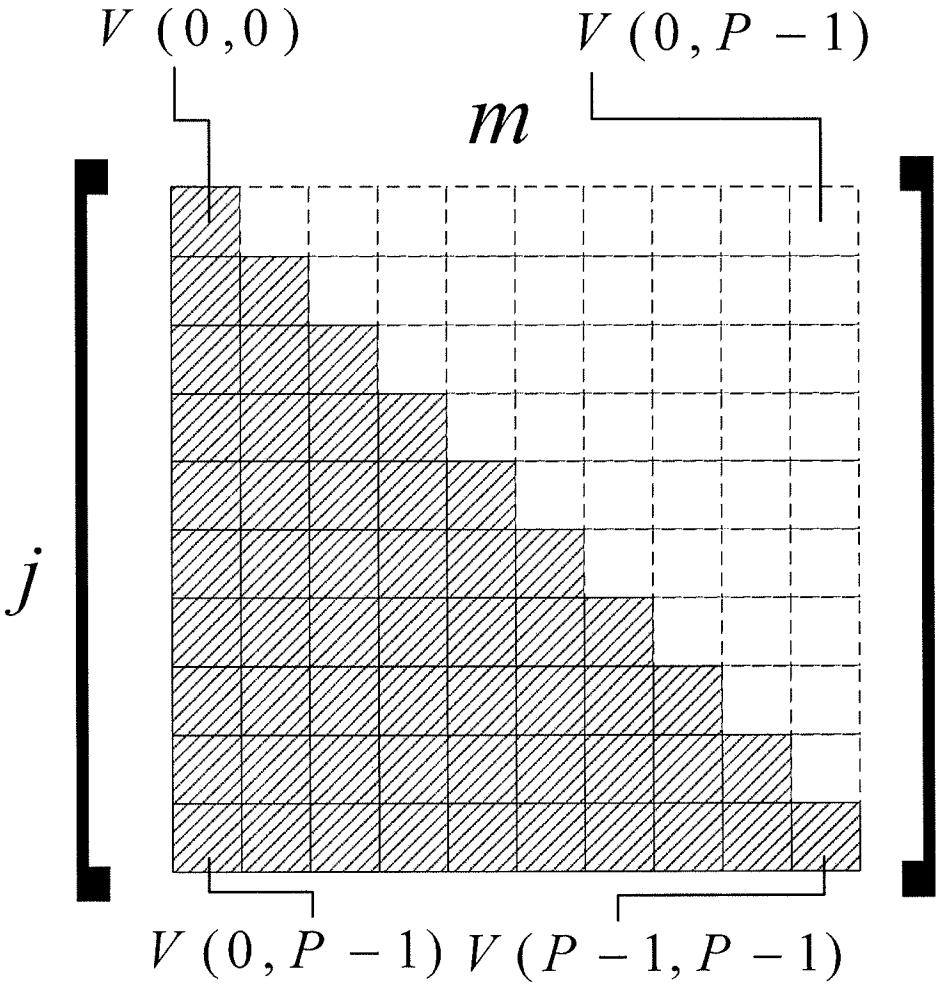
FIG. 7 is a conceptual configuration diagram of the auto-correlation matrix in FIG. 6.

Furthermore, FIG. 7 is a conceptual configuration diagram of the auto-correlation matrix in FIG. 6. It is assumed that each region in FIG. 7 indicates each element (matrix element) (V(j, m)) in FIG. 6. Furthermore, since the regions enclosed by a broken line in the upper right area of the matrix correspond to the regions at the lower left area (shaded area) of the matrix respectively, the calculation of the auto-correlation can be actually omitted. FIG. 7 only shows the concept of the configuration of the auto-correlation matrix, an example of case where order P of the filter coefficient is 10, and the number of regions (matrix elements), that is, the order of the filter coefficient is not limited to this.

Figure 8:
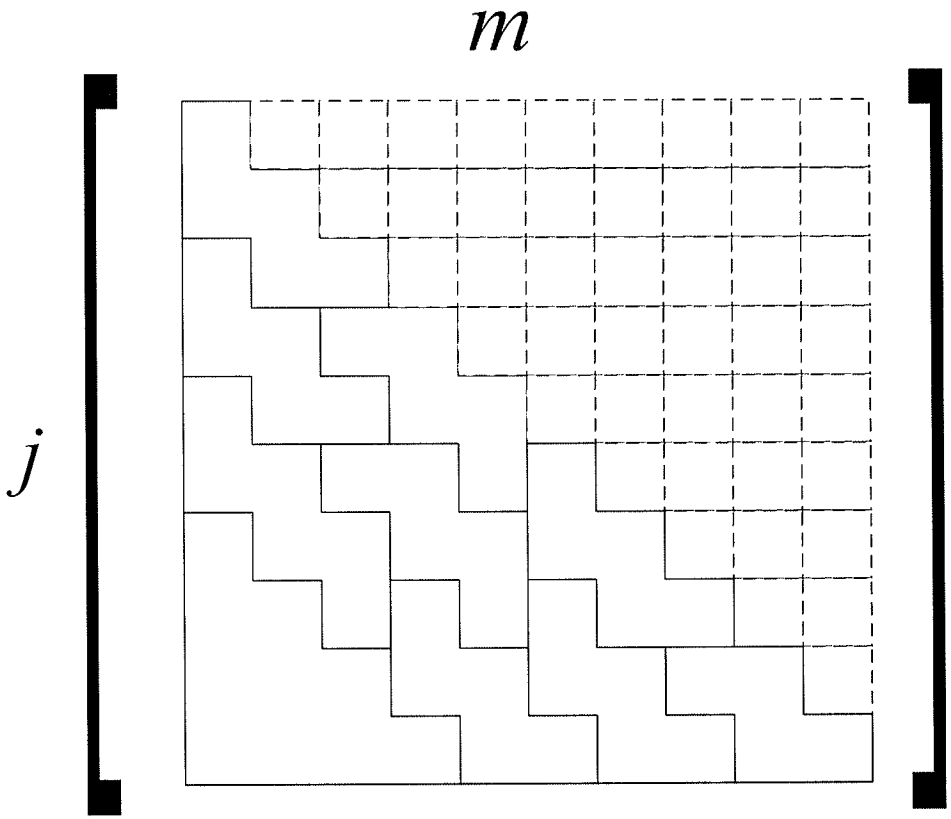
FIG. 8 is a diagram illustrating an example of the simplified auto-correlation matrix.

When accurate subframe energy is calculated according to equation 5, the entire auto-correlation matrix in FIG. 6 (or FIG. 7) needs to be calculated, which will require an enormous amount of calculation. Thus, subframe energy calculation section 201 of the present invention simplifies the auto-correlation matrix as shown in FIG. 8 (hereinafter, referred to as "simplified auto-correlation matrix"). To be more specific, grouping section 2012 of subframe energy calculation section 201 groups the elements of the auto-correlation matrix into a plurality of groups in accordance with variables j and m. Here, the simplified auto-correlation matrix in FIG. 8 is a simplified version of the conceptual configuration diagram of the auto-correlation matrix shown in FIG. 7.

Figure 9:
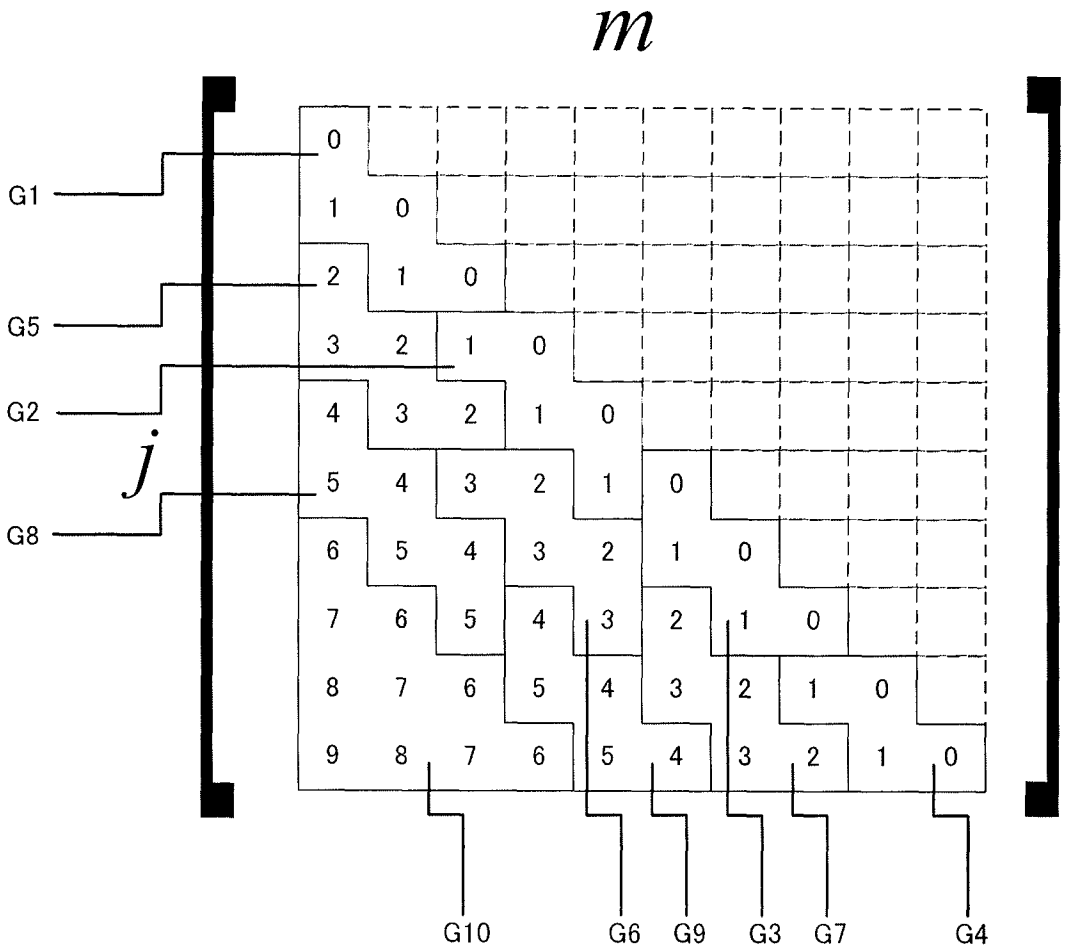
FIG. 9 is a diagram illustrating a grouping method.

FIG. 8 is an example where grouping section 2012 groups the respective elements of the auto-correlation matrix in accordance with variables j and m. In the example in FIG. 8, for a greater difference between variables j and m, grouping section 2012 sets a greater group region (hereinafter, referred to as "group region"). FIG. 9 is a diagram showing the correspondence between the difference between variables j and m, and each group. In FIG. 9, number 0 to 9 shown in each region indicates the difference between variables j and m. In the example shown in FIG. 9, the respective elements whose difference between variables j and m is 0 or 1 are grouped into groups G1 to G4, with each group being composed of 5 elements. Furthermore, the respective elements whose difference between variables j and m is 2 or 3 are grouped into groups G5 to G7, with each group being composed of 5 elements. Furthermore, the respective elements whose difference between variables j and m is 4 or 5 are grouped into groups G8 and G9, with each group being composed of 6 elements. Furthermore, 10 elements whose difference between variables j and m is 6, 7, 8 or 9 are grouped into group G10. That is, in the example in FIG. 8, elements having a greater difference in values between variables j and m are grouped into a configuration in which auto-correlation values are more simplified (approximated).

That is, as is also clear from FIG. 8 and FIG. 9, the simplified auto-correlation matrix is created based on an idea that the greater the difference between variables j and in, the coarser (more simplified) resolution of each value of the auto-correlation matrix is set.

Grouping section 2012 outputs grouping information to operation section 2011.

Operation section 2011 then calculates auto-correlation values assuming that all elements belonging to the same group have the same auto-correlation value. At this time, as the auto-correlation value in the same group, operation section 2011 sets, for example, an auto-correlation value of an element having the minimum sum of j and m in the group.

Operation section 2011 of subframe energy calculation section 201 calculates auto-correlation corresponding to each symbol according to equation 6 based on the simplified auto-correlation matrix in FIG. 8 and calculates subframe energy according to equation 5 using the calculated value.

When the cases in FIG. 7 and FIG. 8 are taken as an example for explanation, auto-correlation needs to be calculated 55 times (55 regions in FIG. 7) under normal circumstances. On the other hand, in the present invention, grouping section 2012 of subframe energy calculation section 201 groups the respective elements of the auto-correlation matrix into a plurality of groups. In the example shown in FIG. 8, the respective elements of the auto-correlation matrix are grouped into 10 groups G1 to G10. Subframe energy calculation section 201 sets, for example, an auto-correlation value of an element having the minimum sum of j and m in each group as an auto-correlation value of all elements included in the group. When the respective elements are grouped into 10 groups as shown in FIG. 8 by approximating the auto-correlation values in this way, the present invention requires only 10 auto-correlation calculations, and can thereby drastically reduce the amount of calculation.

That is, the present invention approximates (substitutes) the sum ($\Sigma x_{i-j}x_{i-m}$) of auto-correlation operations within a certain range (i, j) of an input signal that must be calculated when calculating accurate frame energy (subframe energy) with the sum ($\Sigma x_{i-j'}x_{i-m'}$) of auto-correlation operations within another range (i', j'). For example, in the example of FIG. 8, the sum ($\Sigma x_{i-9}x_{i-6}$) of auto-correlation operations of (j, m)=(9, 6) is substituted with the sum ($\Sigma x_{i-6}x_{i-0}$) of auto-correlation operations of (j', m')=(6, 0) whose j and m have minimum values among elements included in group G10 containing (j, m)=(9, 6).

Furthermore, by controlling the frequency of approximation (substitution) in accordance with a delay time (time difference between signals whose correlation is calculated) during auto-correlation operation, it is possible to suppress deterioration of the accuracy of frame energy (subframe energy) calculation. To be more specific, as the delay time during auto-correlation operation increases, that is, as the difference between variables j and m in equation 5 increases, the frequency of approximation is increased, and it is thereby possible to suppress deterioration of the accuracy in energy calculation. That is, the greater the delay time during auto-correlation operation, that is, the greater the difference between variables j and m in equation 5, the greater group region is set by grouping section 2012. In other words, grouping section 2012 performs control so as to increase the frequency of substitution with the sum of auto-correlation operations in the identical second range as the delay time (difference between variables j and m) during auto-correlation operation increases. Thus, when the delay time (difference between variables j and m) during auto-correlation operation is large, the frequency with which the sum ($\Sigma x_{i-j}x_{i-m}$) of auto-correlation operations within a certain range (i, j) of an input signal is approximated with the sum ($\Sigma x_{i-j'}x_{i-m'}$) of auto-correlation operation within another range (i', j') increases, and it is thereby possible to reduce the amount of calculation of auto-correlation.

Figure 10:
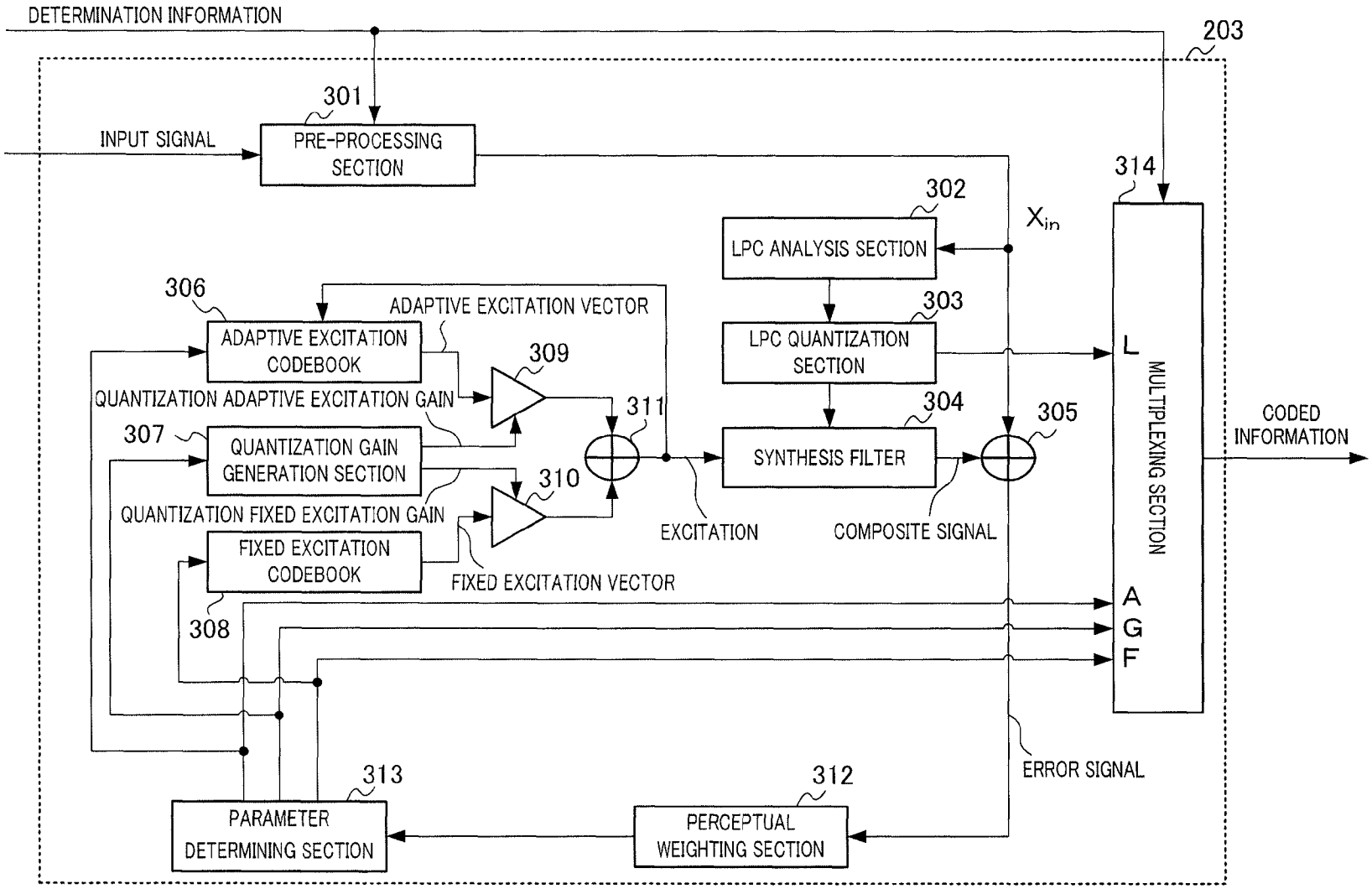
FIG. 10 is a block diagram illustrating a principal internal configuration of the CELP coding section according to Embodiment 1 shown in FIG. 2.

FIG. 10 is a block diagram illustrating a principal internal configuration of CELP coding section 203. CELP coding section 203 includes pre-processing section 301, LPC (Linear Prediction Coefficients) analysis section 302, LPC quantization section 303, synthesis filter 304, adding section 305, adaptive excitation codebook 306, quantization gain generation section 307, fixed excitation codebook 308, multiplying sections 309 and 310, adding section 311, perceptual weighting section 312, parameter determining section 313, and multiplexing section 314.

Determination information outputted from determining section 202 is inputted to pre-processing section 301.

In FIG. 10, when determination information $I_k$ (k=0, . . . , $N_s$−1) is 1, pre-processing section 301 performs, on the input signal, high pass filter processing of removing a DC component, and waveform shaping processing or pre-emphasis processing for improving performance of subsequent coding processing. Pre-processing section 301 then outputs signal $X_{in}$ obtained by applying these processes to LPC analysis section 302 and adding section 305. When determination information $I_k$ (k=0, . . . , $N_s$−1) is 0, that is, when subframe energy of the input signal is 0, pre-processing section 301 does not perform pre-processing and outputs nothing to the subsequent processing block. That is, when determination information $I_k$ (k=0, . . . , $N_s$−1) is 0, CELP coding section 203 does not perform CELP coding processing. Therefore, processing in the sections other than pre-processing section 301 and multiplexing section 314 in the case where determination information $I_k$ (k=0, . . . , $N_s$−1) is 1 will be described hereinafter.

LPC analysis section 302 performs linear predictive analysis using signal $X_{in}$ inputted from pre-processing section 301 and outputs the analysis result (linear prediction coefficient) to LPC quantization section 303.

LPC quantization section 303 performs quantization processing on the linear prediction coefficient (LPC) inputted from LPC analysis section 302, outputs the quantized LPC to synthesis filter 304 and outputs a code (L) representing the quantized LPC to multiplexing section 314.

Synthesis filter 304 performs a filter synthesis on excitation inputted from adding section 311 which will be described later using a filter coefficient based on the quantized LPC inputted from LPC quantization section 303, generates a synthesized signal and outputs the synthesized signal to adding section 305.

Adding section 305 inverts the polarity of the synthesized signal inputted from synthesis filter 304, adds the synthesized signal with the inverted polarity to signal $X_{in}$ inputted from pre-processing section 301, thereby calculates an error signal and outputs the error signal to perceptual weighting section 312.

Adaptive excitation codebook 306 stores excitation outputted in the past from adding section 311 in a buffer, extracts samples corresponding to one frame from the past excitation specified by the signal inputted from parameter determining section 313 which will be described later, as an adaptive excitation vector, and outputs the samples to multiplying section 309.

Quantization gain generation section 307 outputs a quantization adaptive excitation gain and a quantization fixed excitation gain specified by the signal inputted from parameter determining section 313 to multiplying section 309 and multiplying section 310 respectively.

Fixed excitation codebook 308 outputs a pulse excitation vector having a shape specified by a signal inputted from parameter determining section 313 to multiplying section 310 as a fixed excitation vector. A vector obtained by multiplying the pulse excitation vector by a spreading vector may also be outputted to multiplying section 310 as the fixed excitation vector.

Multiplying section 309 multiplies the adaptive excitation vector inputted from adaptive excitation codebook 306 by the quantization adaptive excitation gain inputted from quantization gain generation section 307 and outputs the multiplication result to adding section 311. Furthermore, multiplying section 310 multiplies the fixed excitation vector inputted from fixed excitation codebook 308 by the quantization fixed excitation gain inputted from quantization gain generation section 307 and outputs the multiplication result to adding section 311.

Adding section 311 performs vector addition on the adaptive excitation vector multiplied by the gain inputted from multiplying section 309 and the fixed excitation vector multiplied by the gain inputted from multiplying section 310 and outputs excitation, which is the addition result, to synthesis filter 304 and adaptive excitation codebook 306. The excitation outputted to adaptive excitation codebook 306 is stored in the buffer of adaptive excitation codebook 306.

Perceptual weighting section 312 performs perceptual weighting on the error signal inputted from adding section 305 and outputs the error signal to parameter determining section 313 as coding distortion.

Parameter determining section 313 selects an adaptive excitation vector, fixed excitation vector and quantization gain that minimize the coding distortion inputted from perceptual weighting section 312 from adaptive excitation codebook 306, fixed excitation codebook 308 and quantization gain generation section 307 respectively, and outputs an adaptive excitation vector code (A), fixed excitation vector code (F) and quantization gain code (G) showing the selection results to multiplexing section 314.

Determination information is inputted to multiplexing section 314 from determining section 202. When determination information $I_k$ (k=0, . . . , $N_s$−1) is 1, multiplexing section 314 multiplexes the code (L) indicating the quantized LPC inputted from LPC quantization section 303, adaptive excitation vector code (A) inputted from parameter determining section 313, fixed excitation vector code (F), quantization gain code (G), and determination information $I_k$ (k=0, . . . , $N_s$−1) and outputs the multiplexed code to transmission path 102 as encoded information. When determination information $I_k$ (k=0, . . . , $N_s$−1) is 0, multiplexing section 314 outputs only the determination information to transmission path 102 as encoded information.

The processing in CELP coding section 203 has been described so far.

The processing in coding apparatus 101 has been described so far.

Next, an internal configuration of decoding apparatus 103 shown in FIG. 1 will be described with reference to FIG. 11. Here, a case where decoding section 103 performs CELP type speech decoding will be described.

Figure 11:
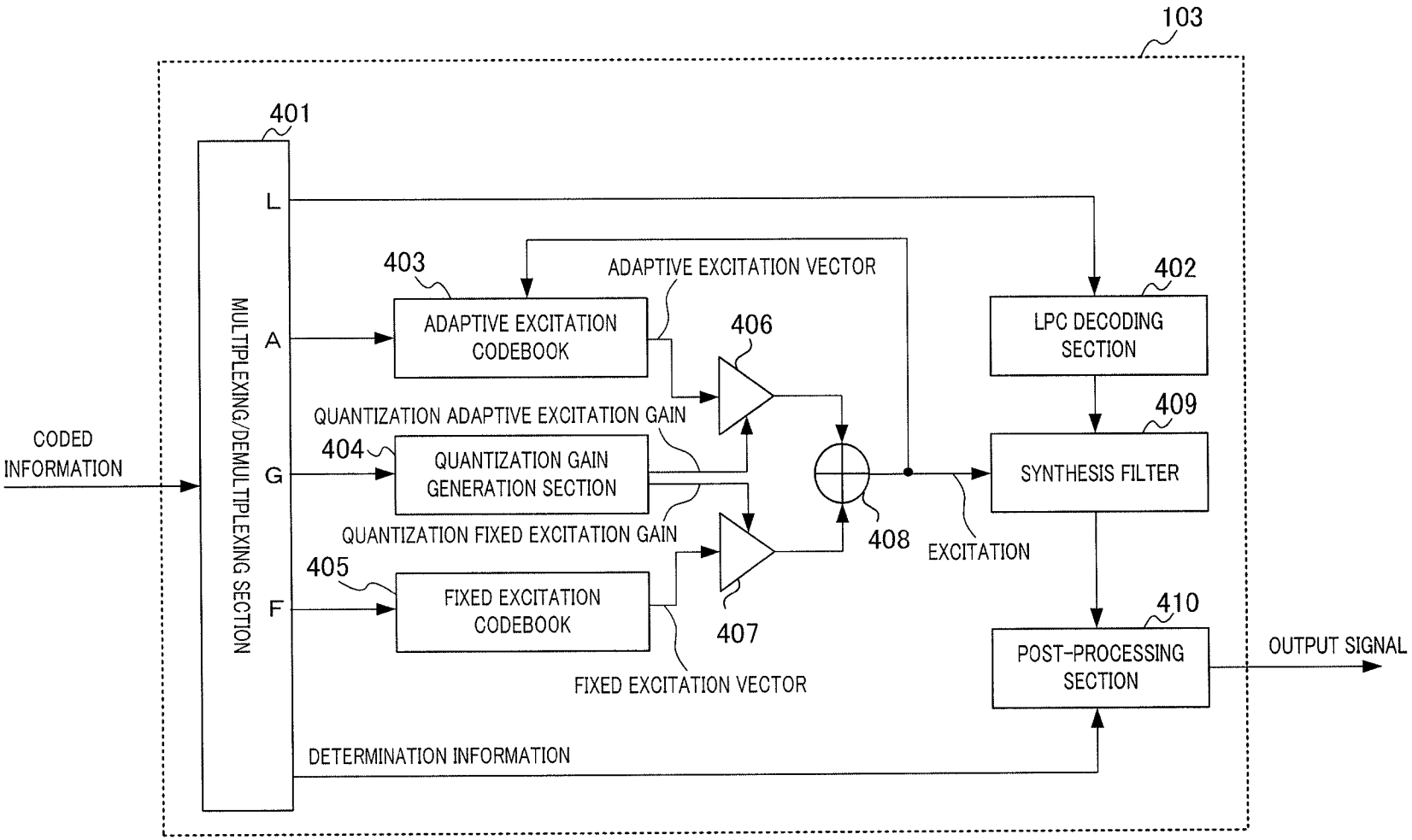
FIG. 11 is a block diagram illustrating a principal internal configuration of the decoding apparatus according to Embodiment 1 shown in FIG. 1.

FIG. 11 is a block diagram illustrating a principal internal configuration of decoding apparatus 103. Decoding apparatus 103 includes demultiplexing section 401, LPC decoding section 402, adaptive excitation codebook 403, quantization gain generation section 404, fixed excitation codebook 405, multiplying sections 406 and 407, adding section 408, synthesis filter 409, and post-processing section 410.

In FIG. 11, demultiplexing section 401 demultiplexes the encoded information inputted from coding apparatus 101 into individual codes (L), (A), (G), (F), and determination information. The demultiplexed LPC code (L) is outputted to LPC decoding section 402. Furthermore, the demultiplexed adaptive excitation vector code (A) is outputted to adaptive excitation codebook 403. Furthermore, the demultiplexed quantization gain code (G) is outputted to quantization gain generation section 404. Furthermore, the demultiplexed fixed excitation vector code (F) is outputted to fixed excitation codebook 405. Furthermore, the demultiplexed determination information is outputted to post-processing section 410. When determination information $I_k$ (k=0, . . . , $N_s$−1) is 0, the individual codes other than the determination information are not included in the encoded information, and therefore suppose that the components other than post-processing section 410 will not perform processing in this case. Therefore, the processing by the components other than post-processing section 410 will be described hereinafter when determination information $I_k$ (k=0, . . . , $N_s$−1) is 1.

LPC decoding section 402 decodes the quantized LPC from the code (L) inputted from demultiplexing section 401 and outputs the decoded quantized LPC to synthesis filter 409.

Adaptive excitation codebook 403 extracts samples corresponding to one frame from past excitation specified by the adaptive excitation vector code (A) inputted from demultiplexing section 401 as adaptive excitation vectors and outputs the samples to multiplying section 406.

Quantization gain generation section 404 decodes the quantization adaptive excitation gain and the quantization fixed excitation gain specified by the quantization gain code (G) inputted from demultiplexing section 401, outputs the quantization adaptive excitation gain to multiplying section 406 and outputs the quantization fixed excitation gain to multiplying section 407.

Fixed excitation codebook 405 generates a fixed excitation vector specified by the fixed excitation vector code (F) inputted from demultiplexing section 401 and outputs the fixed excitation vector to multiplying section 407.

Multiplying section 406 multiplies the adaptive excitation vector inputted from adaptive excitation codebook 403 by the quantization adaptive excitation gain inputted from quantization gain generation section 404 and outputs the multiplication result to adding section 408. On the other hand, multiplying section 407 multiplies the fixed excitation vector inputted from fixed excitation codebook 405 by the quantization fixed excitation gain inputted from quantization gain generation section 404 and outputs the multiplication result to adding section 408.

Adding section 408 adds up the adaptive excitation vector multiplied by the gain inputted from multiplying section 406 and the fixed excitation vector multiplied by the gain inputted from multiplying section 407, generates excitation and outputs the excitation to synthesis filter 409 and adaptive excitation codebook 403.

Synthesis filter 409 performs a filter synthesis of the excitation inputted from adding section 408 using the filter coefficient decoded by LPC decoding section 402 and outputs the synthesized signal to post-processing section 410.

Post-processing section 410 receives determination information $I_k$ (k=0, . . . , $N_s$−1). When determination information $I_k$ (k=0, . . . , $N_s$−1) is 1, post-processing section 410 applies processing of improving subjective quality of speech such as format emphasis or pitch emphasis, and/or processing of improving subjective quality of static noise or the like to the signal inputted from synthesis filter 409 and outputs the processed signal as an output signal. Furthermore, at this time, a storage apparatus provided in post-processing section 410 is caused to store an output signal of the current frame. When determination information $I_k$ (k=0, . . . , $N_s$−1) is 0, post-processing section 410 multiplies the output signal in the past frame stored in the storage apparatus in post-processing section 410 by a predetermined coefficient ($0<\beta<1.0$) and outputs the multiplied signal as an output signal. Furthermore, the storage apparatus is caused to store the output signal at this time. When determination information $I_k$ (k=0, . . . , $N_s$−1) is 0, a method may also be adopted whereby zero output (inactive speech signal) is outputted without performing the above-described processing.

The processing in decoding apparatus 103 shown in FIG. 1 has been described so far.

Embodiment 1 of the present invention has been described so far.

Thus, according to the present embodiment, in the configuration of calculating frame energy or subframe energy of an input signal using auto-correlation operations, performing approximate auto-correlation operations makes it possible to drastically reduce the amount of processing calculation (amount of calculation) without causing deterioration of the accuracy of frame energy or subframe energy.

To be more specific, grouping section 2012 groups respective elements of an auto-correlation matrix into a plurality of groups in accordance with a delay time (that is, difference between j and m) during auto-correlation operation. For example, the greater the delay time (that is, difference between j and m) during auto-correlation operation, the more elements of the auto-correlation matrix are grouped into the same group by grouping section 2012. When filtering processing is performed on input signal $x_i$ (i=$start_k$, . . . , $end_k$), operation section 2011 sets the input signal after filtering as $A_i$ (see equation 3) and sets the sum ($\Sigma x_{i-j}x_{i-m}$) of auto-correlation operations in a first range (j, m) of this input signal $A_i$ as the sum ($\Sigma x_{i-j'}x_{i-m'}$) of auto-correlation operations in a second range (j', m') in the same group as the first range. Thus, as the delay time (difference between j and in (time difference)) during auto-correlation operation in the first range (j, m) increases, grouping section 2012 increases the frequency of substitution with the sum of auto-correlation operations in the same second range (j', m'). That is, as the difference between j and m in equation 5 increases, grouping section 2012 increases the number of combinations of j and m to be substituted by auto-correlation operations at j' and m'. Thus, instead of simply using an average value, it is possible to approximate the auto-correlation operations in the first range, and thereby reduce the amount of calculation without causing deterioration of the calculation accuracy.

Figure 12:
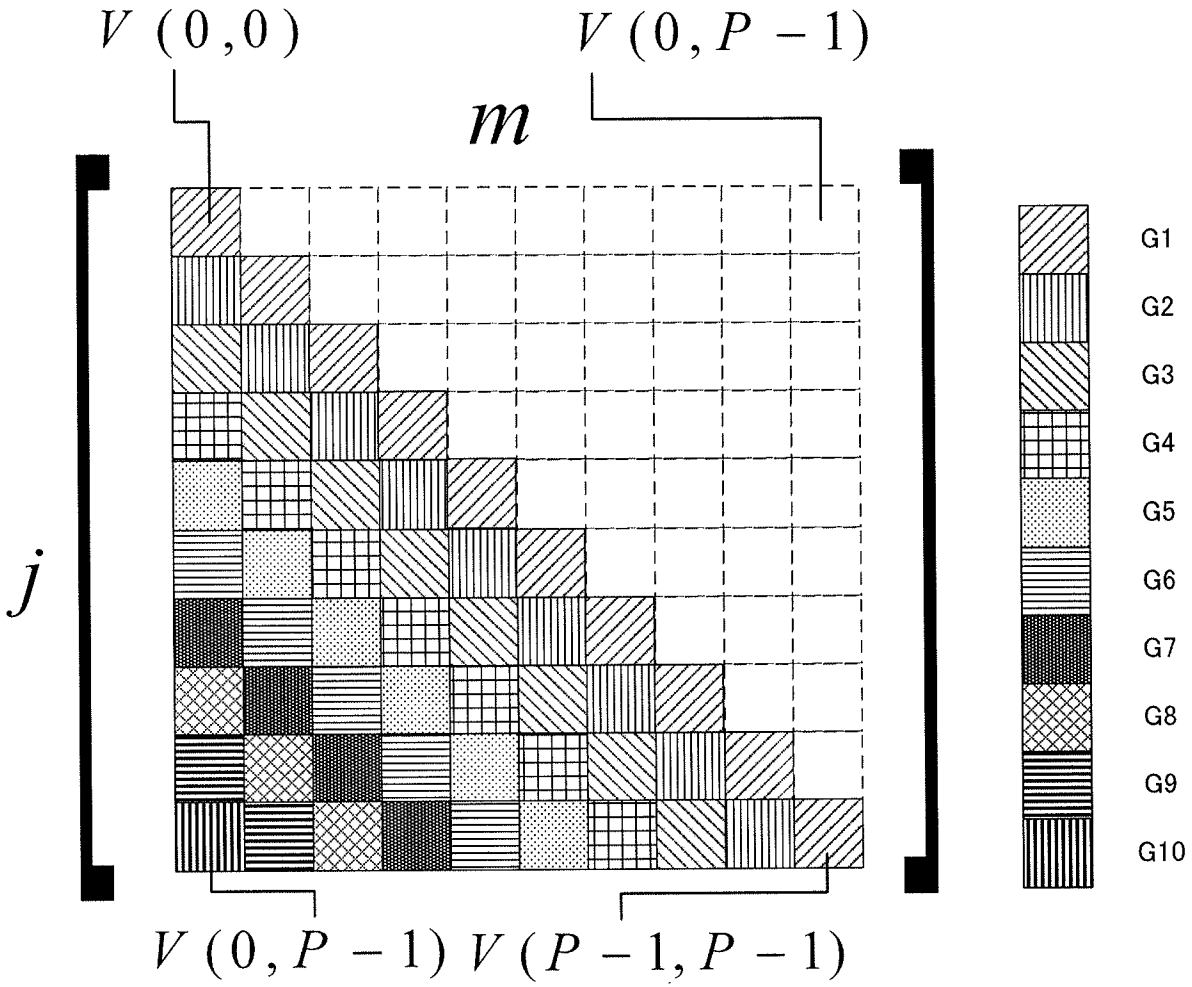
FIG. 12 is a diagram illustrating another example of the simplified auto-correlation matrix.

As an example of approximation of auto-correlation operations, a case has been described in the present embodiment as shown in FIG. 8 where the greater the difference between variables j and m in auto-correlation operations using variables j and m, the more simplified (approximate) configuration (grouping method) is adopted. However, the present invention is not limited to this, but is likewise applicable to other simplified (approximation) schemes (grouping methods). For example, in FIG. 8, although the values of auto-correlation operation corresponding to regions having different j (or m) values are set to be the same, a method is also effective whereby grouping section 2012 of subframe energy calculation section 201 groups regions where differences between j and m are equal like a Toeplitz matrix. FIG. 12 shows this configuration example. In FIG. 12, group G1 is a group where the difference between j and m corresponds to 0. Likewise, groups G2 to 10 are groups where the difference between j and m corresponds to 1 to 9, respectively.

Figure 13:
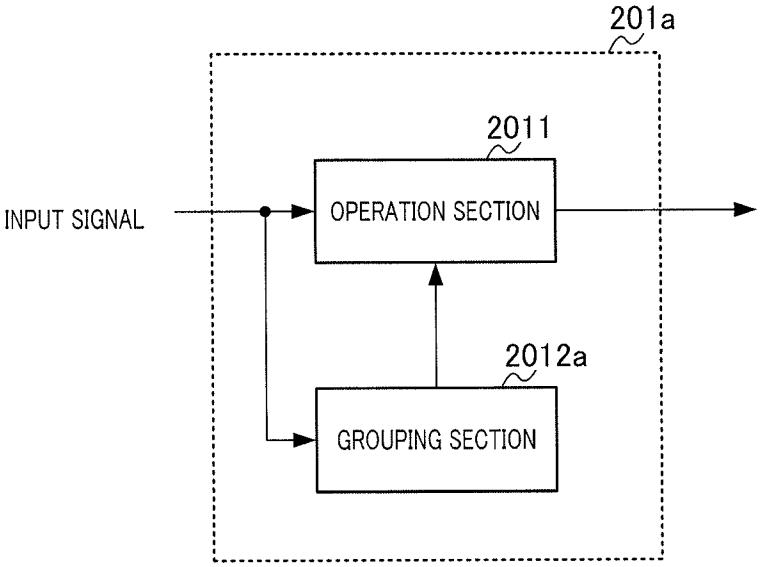
FIG. 13 is a block diagram illustrating a configuration of a subframe energy calculation section different from FIG. 3.

Furthermore, a configuration in which a grouped region is determined in accordance with the position of a sample having large amplitude in an input signal can also be taken as an example. FIG. 13 shows an example of subframe energy calculation section 201*a* in this case. The difference from subframe energy calculation section 201 in FIG. 3 lies in that grouping section 2012*a* that receives an input signal is arranged instead of grouping section 2012. In this configuration, for example, grouping section 2012*a* of subframe energy calculation section 201*a* searches subframes of the input signal to see whether or not there is a sample whose amplitude is equal to or greater than a threshold. There may be a configuration in which when there is a sample having the amplitude equal to or greater than the threshold, grouping section 2012*a* sets a grouping boundary between when the auto-correlation operation includes the corresponding sample and when not. To be more specific, grouping section 2012*a* groups a range (matrix elements) including a sample where the amplitude of the input signal is equal to or greater than a threshold into the same group (group 1) to distinguish it from a group of range not including any sample having the amplitude equal to or greater than the threshold. That is, the range not including the sample having the amplitude equal to or greater than the threshold is grouped into another group (group 2). Operation section 2011 then substitutes the sum of auto-correlation operations in the first range (i, j) that belongs to group 1 with auto-correlation operations in the second range (i', j') that belongs to group 1. Furthermore, operation section 2011 substitutes the sum of auto-correlation operations in a third range (i, j) that belongs to group 2 with auto-correlation operations in a fourth range (i', j') that belongs to group 2. Thus, it is possible to avoid auto-correlation operations in the range including the sample where the amplitude of the input signal is equal to or greater than the threshold from being substituted with auto-correlation operations having completely different values, and thereby suppress deterioration of the calculation accuracy caused by the substitution.

The above-described grouping method can also be combined with the grouping method described in the present embodiment.

A configuration has been described in the present embodiment where the value (typical value) of auto-correlation corresponding to each grouped region of a simplified matrix is set to a value of a region having the minimum sum of j and m, but the present invention is not limited to this, and is likewise applicable to a configuration in which a value other than that described above is set as the value of auto-correlation of the grouped region. For example, a value of a central region in each grouped region (e.g., region where the center of gravity of a grouped region exists) may be set as a typical value.

In addition to the above-described typical value determining method, a method may also be adopted whereby a typical value is efficiently set in an attacking portion (transient portion) or the like. Here, the attacking portion (transient portion) refers to, for example, a portion where the signal level of a speech signal drastically increases, that is, a portion of a speech signal in which the amplitude immediately after the portion is considerably greater than the amplitude immediately before the portion. For example, in a frame in which an inactive speech state is switched to an active speech state, a sample with quite small energy exists at the beginning followed by samples having greater energy. That is, an attacking portion exists.

In this case, if, for example, a value close to the right bottom on the auto-correlation matrix in FIG. 12 is set as a typical value, an error may increase when auto-correlation values are calculated using a sample which originally has small energy, causing the accuracy of energy calculation to deteriorate considerably. A strange sound may also be produced in some cases.

Thus, for such an attacking portion, by setting the value close to the left top on the auto-correlation matrix in FIG. 12 as a typical value, it is possible to reduce the error in the case where an extremely small auto-correlation value is originally calculated.

Furthermore, to the contrary to the attacking portion, in a frame in which an active speech state is switched to an inactive speech state, a sample with extremely large energy exists at the beginning followed by samples having small energy. In this case, for example, by setting the value close to the left bottom on the auto-correlation matrix in FIG. 12 as a typical value, it is possible to reduce the error when an extremely small auto-correlation value is originally required for the same reason as that described above.

Thus, when the variation in the amplitude of the sample is large due to, for example, switching between active speech and inactive speech in a frame or subframe, auto-correlation operations at j and m are substituted with auto-correlation operations at j' and m' including a sample with small amplitude. Adaptively determining typical values as described above makes it possible to further reduce errors of auto-correlation operation with respect to the entire frame or subframe.

The present embodiment has described a method of reducing the amount of calculation when calculating subframe energy of an input signal using auto-correlation operation without causing deterioration of the calculation accuracy, but the present invention is not limited to this, and is likewise applicable to a case where frame energy of an input signal is calculated. In this case, instead of equation 1, equation 3 to equation 6 described in the present embodiment, equation 2, equation 7 to equation 10 are used respectively. There is no concept of subframe in equation 2, equation 7 to equation 10, and suppose that all processing is performed in frame units.

(Equation 7)

$$A_i = \sum_{j=0}^{P-1} \alpha_j x_{i-j} \quad [7]$$

($i$ = start, … , end)

(Equation 8)

$$\begin{aligned} E_k &= \sum_i A_i^2 \quad [8] \\ &= \sum_i \left\{ \sum_{j=0}^{P-1} \alpha_j x_{i-j} \right\}^2 \\ &= \sum_i \left( \sum_{j=0}^{P-1} \alpha_j x_{i-j} \right) \left( \sum_{m=0}^{P-1} \alpha_m x_{i-m} \right) \\ &= \sum_{j=0}^{P-1} \sum_{m=0}^{P-1} \alpha_j \alpha_m \sum_i x_{i-j} x_{i-m} \end{aligned}$$

($i$ = start, … , end)

-continued (Equation 9)

$$\begin{aligned} E_k &= \sum_i A_i^2 \quad [9] \\ &= \sum_{j=0}^{P-1} \sum_{m=0}^{P-1} \alpha_j \alpha_m \sum_i x_{i-j} x_{i-m} \\ &= \alpha_0 \alpha_0 \sum_i x_i x_i + \alpha_0 \alpha_1 \sum_i x_i x_{i-1} + \ldots + \\ &\quad \alpha_0 \alpha_{P-1} \sum_i x_i x_{i-(P-1)} + \alpha_1 \alpha_0 \sum_i x_{i-1} x_i + \\ &\quad \alpha_1 \alpha_1 \sum_i x_{i-1} x_{i-1} + \ldots + \alpha_1 \alpha_{P-1} \sum_i x_{i-1} x_{i-(P-1)} \\ &\quad \vdots + \\ &\quad \alpha_{P-1} \alpha_0 \sum_i x_{i-(P-1)} x_i + \alpha_{P-1} \alpha_1 \sum_i x_{i-(P-1)} x_{i-1} + \ldots + \\ &\quad \alpha_{P-1} \alpha_{P-1} \sum_i x_{i-(P-1)} x_{i-(P-1)} \end{aligned}$$

($i$ = start, … , end)

(Equation 9)

$$\begin{aligned} V(j, m) &= V(m, j) \quad [10] \\ &= \sum_i x_{i-j} x_{i-m} \end{aligned}$$

($i$ = start, … , end)

Furthermore, subframe energy calculation section 201/201*a* according to the present embodiment is not limited to a coding apparatus, but is also useful as a signal processing apparatus that calculates energy in subframe (or frame) units.

Embodiment 2

Embodiment 2 will describe a configuration in which a grouping method is adaptively set for each frame process or subframe process in the auto-correlation matrix described in Embodiment 1. A case has been described in Embodiment 1 (FIG. 8, FIG. 9) where grouping is fixed over an entire frame, but adaptively setting the grouping makes it possible to further improve operation accuracy. Furthermore, processing will be described below based on the matrix configuration in FIG. 12 described in Embodiment 1.

Since a communication system including a coding apparatus and a decoding apparatus according to the present embodiment of the present invention has the same configuration as that shown in Embodiment 1 (FIG. 1), illustration and description thereof will be omitted. Furthermore, since the internal configuration of the coding apparatus according to the present embodiment is the same as the configuration shown in Embodiment 1 (FIG. 2), Illustration and description thereof will be omitted. Furthermore, since the internal configuration of the subframe energy calculation section according to the present embodiment has the same configuration as the configuration shown in Embodiment 1 (FIG. 3), the internal configuration will be described using FIG. 3. Furthermore, since the internal configuration of the decoding apparatus according to the present embodiment has the same configuration as the configuration shown in Embodiment 1 (FIG. 11), illustration and description thereof will be omitted.

It is assumed that grouping section 2012 in the coding apparatus of the present embodiment performs grouping based on a grouping method such as the Toeplitz matrix shown in FIG. 12 described in Embodiment 1.

The grouping method as shown in FIG. 12 described in Embodiment 1 groups respective elements of the auto-correlation matrix for each region having the same difference between j and m and is simplified so as to have the same auto-correlation operation value within the group. This provides an advantage that it is possible to drastically reduce the number of times auto-correlation operation is performed. However, when elements having significantly different auto-correlation operation values exist within the same group, there is a problem that a large operation error results.

Thus, the present embodiment will describe a configuration based on the grouping method as shown in FIG. 12 that suppresses errors in auto-correlation operation by dividing a group into two parts. For simplicity of description, a case will be described below where only a group whose j and m values are identical (group on the diagonal of an auto-correlation matrix) is divided into two parts.

Figure 14:
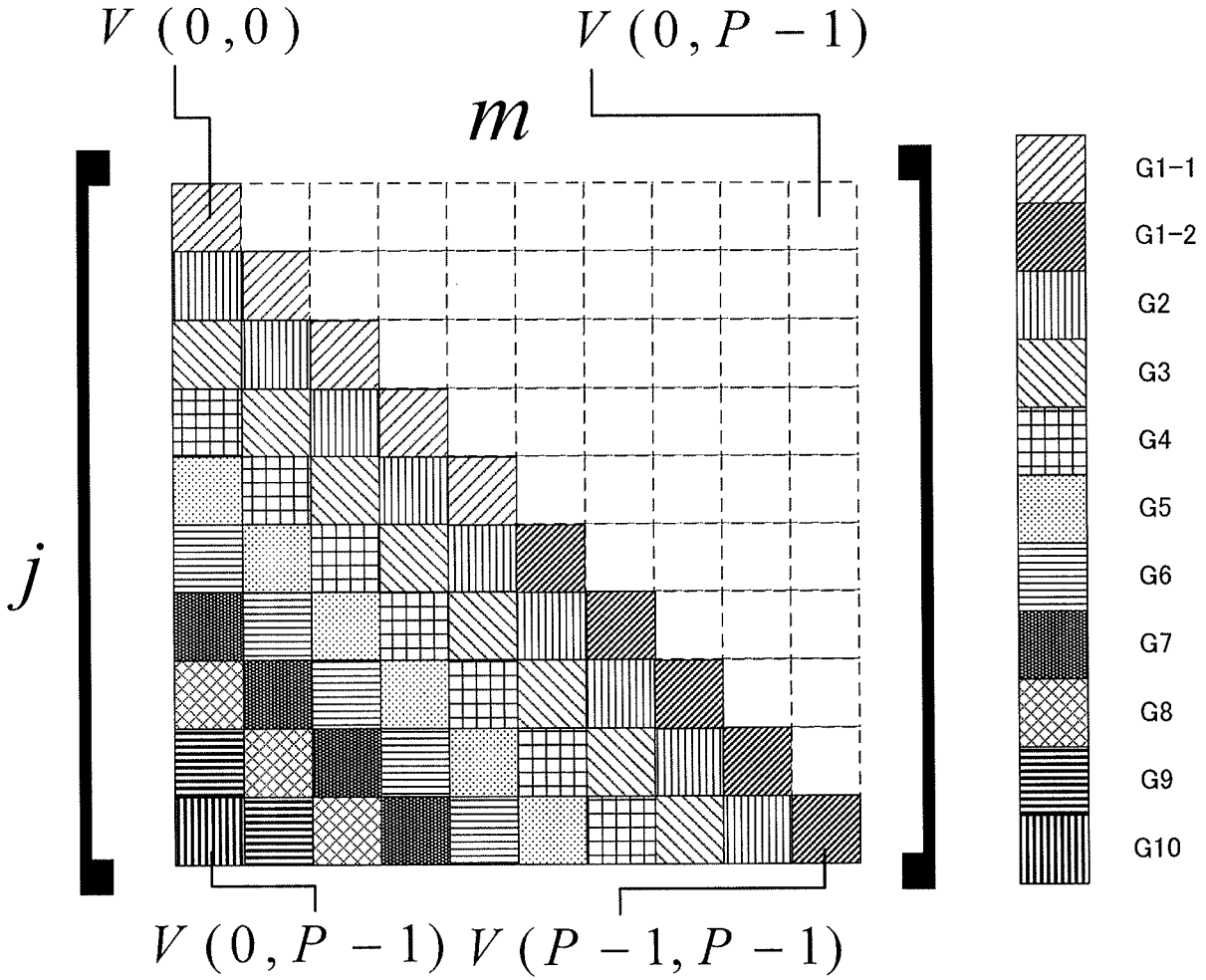
FIG. 14 is a diagram illustrating another example of the simplified auto-correlation matrix according to Embodiment 2 of the present invention.

FIG. 14 shows a grouping example in this case. In FIG. 14, a group where j and m values are identical (group on the diagonal of an auto-correlation matrix), that is, group G1 in FIG. 12 is divided into two groups: group G1-1 and group G1-2.

Next, how to divide group G1 into two parts will be described below.

Figure 15:
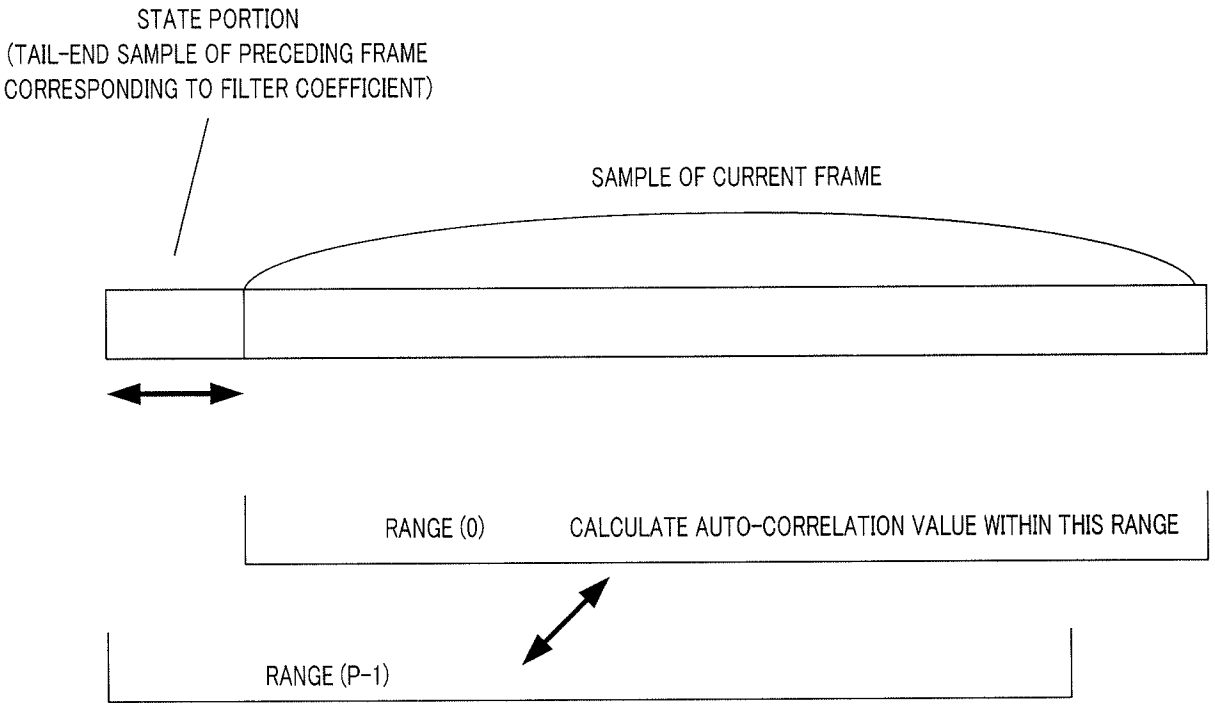
FIG. 15 is a block diagram illustrating a target range of auto-correlation operation.

FIG. 15 shows a target range in which auto-correlation operation is performed in group G1 in a simplified form. Of group G1 of the auto-correlation matrix, the range from the left top element to the right bottom element in which auto-correlation operation is performed is changed from range (0) to range (P−1) as shown in FIG. 15. Grouping section 2012 in the present embodiment searches for sample index i that maximizes equation 11 below and divides group G1 into two subgroups G1-1 and G1-2 using this index i as a division point. Here, in equation 11, L represents a subframe length.

$$\max_{\text{start}}|(x_i^2+y_{i+L}^2)-(x_{i-1}^2+y_{i+L-1}^2)|(i=\text{start}-(P-1),\ldots, \quad \text{(Equation 11)}$$

The example in FIG. 14 shows a case where the division point is just a midpoint of the search range, that is, the division point is $i=\text{start}_i+(P-1)/2$.

Figure 16:
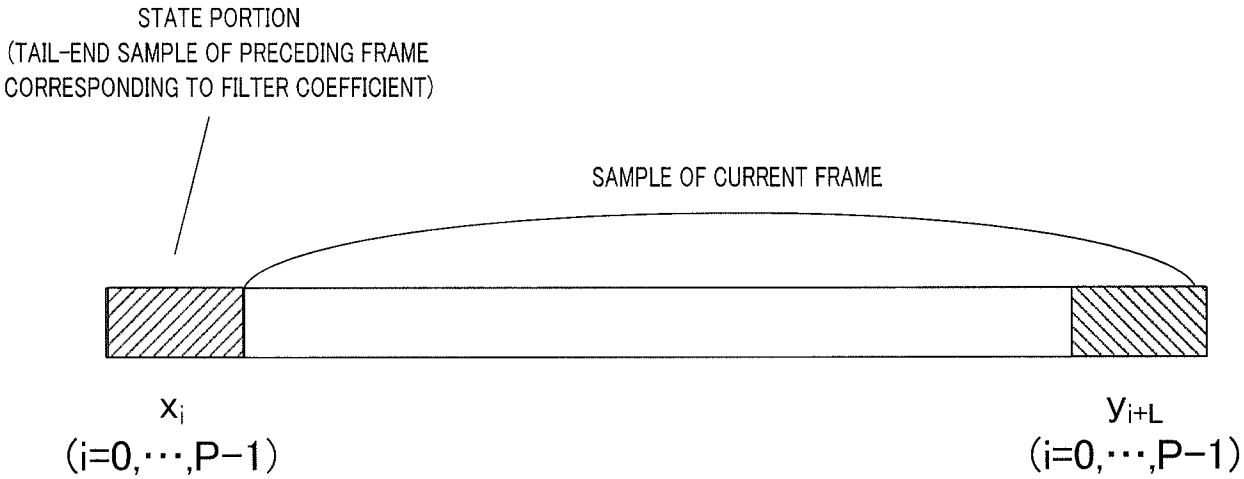
FIG. 16 is a diagram illustrating a frame configuration in adaptive group division processing.

FIG. 16 shows an overview of search processing on the division point in equation 11. It is assumed that the state portion in FIG. 16 is $x_i$, and the length from the tail-end portion of a frame to the state portion, that is, a portion of the order of the filter is $y_{i+L}$. However, for simplicity of description, a case will be described where processing is performed in frame units, not in subframe units.

Here, equation 11 shows a variation of frame energy when the target range of correlation operation is shifted by one sample at a time. Therefore, a point that maximizes equation 11 is a point at which the variation of frame energy is largest, and when grouping section 2012 divides the group at that point, it is possible to statistically reduce the number of errors in correlation operation accompanying the grouping. As described above, FIG. 16 shows a configuration during frame processing, and during subframe processing, the start position ($\text{start}_k$) of each subframe may be added to the start positions of $x_i$ and $y_{i+L}$ and the division point can be obtained using the same method as that described above.

Thus, according to the present embodiment, performing approximate auto-correlation operation in a configuration in which frame energy or subframe energy of an input signal is calculated using auto-correlation operations makes it possible to drastically reduce the amount of processing calculation (amount of calculation) without causing deterioration of the accuracy of frame energy or subframe energy. Furthermore, in approximate auto-correlation operation processing, adaptively determining the approximation method of auto-correlation operation processing in processing frame (or subframe) units makes it possible to further suppress deterioration of the accuracy of frame energy or subframe energy.

Although the present embodiment has described a configuration in which the division method is adaptively set when part of a Toeplitz matrix is divided into two parts as shown in FIG. 14, as an example, the present invention is not limited to this, but is likewise applicable to a case where part of the Toeplitz matrix is divided into three or more groups. In this case, in addition to the point where equation 11 is maximized, a point where the value of equation 11 becomes the second largest may be set as a second division point. Furthermore, when part of the Toeplitz matrix is divided into k (k is an integer equal to or greater than 3) groups, a point where the value of equation 11 becomes the (k−1)-th largest may be set as a (k−1)-th division point.

Furthermore, although the present embodiment has described a configuration in which some groups of a Toeplitz matrix are divided as shown in FIG. 14 as an example, the present invention is not limited to this, but is likewise applicable to a case where all groups of the Toeplitz matrix are divided. Furthermore, the present invention is likewise applicable to a case of grouping of other than a Toeplitz matrix (for example, the case of grouping as shown in FIG. 9).

Furthermore, although the present embodiment does not particularly refer to a typical value of each group (each subgroup) of a grouped auto-correlation matrix, it is possible to calculate a typical value as in the case of Embodiment 1 using the method described in Embodiment 1. For example, an auto-correlation operation value corresponding to the left top element of each group (each subgroup) may be assumed to be a typical value of each group (each subgroup).

Furthermore, an auto-correlation operation value corresponding to the central element of each group (each subgroup) may be assumed to be a typical value, and it is thereby possible to statistically reduce an error in auto-correlation operation with respect to the entire auto-correlation matrix.

Furthermore, the coding apparatus, decoding apparatus and method thereof according to the present invention are not limited to each of the above embodiments, but may be implemented modified in various ways.

Although the decoding apparatus in each of the above embodiments has been assumed to perform processing using encoded information transmitted from the coding apparatus in each of the above embodiments, the present invention is not limited to this, but encoded information containing necessary parameter or data can be processed even if it is not necessarily encoded information from the coding apparatus in each of the above embodiments.

Furthermore, the present invention is also applicable to cases where a signal processing program is written into a mechanically readable recording medium such as memory, disk, tape, CD, DVD and operated, and operations and effects similar to those in each of the above embodiments may be obtained.

Also, although cases have been described with each of the above embodiments as examples where the present invention is configured by hardware, the present invention can also be implemented by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2011-006211, filed on Jan. 14, 2011 and Japanese Patent Application No. 2011-054919, filed on Mar. 14, 2011, including the specifications, drawings and abstracts are incorporated herein by reference in their entirety.

INDUSTRIAL APPLICABILITY

The coding apparatus, communication processing apparatus and coding method according to the present invention can efficiently reduce the amount of operation when calculating frame energy or subframe energy of an input signal using auto-correlations and are applicable to, for example, a communication system or mobile communication system.

REFERENCE SIGNS LIST

101 Coding apparatus
102 Transmission path
103 Decoding apparatus
201, 201*a* Subframe energy calculation section
2011 Operation section
2012, 2012*a* Grouping section
202 Determining section
203 CELP coding section
301 Pre-processing section
302 LPC analysis section
303 LPC quantization section
304, 409 Synthesis filter
305, 311, 408 Adding section
306, 403 Adaptive excitation codebook
307, 404 Quantization gain generation section
308, 405 Fixed excitation codebook
309, 310, 406, 407 Multiplying section
312 Perceptual weighting section
313 Parameter determining section
314 Multiplexing section
401 Demultiplexing section
402 LPC decoding section
410 Post-processing section

The invention claimed is:

1. A coding apparatus, comprising:

a memory;

a receiver that receives a speech/sound signal;

an energy processor that divides the speech/sound signal into subframes and that calculates one of frame energy and subframe energy of the speech/sound signal using an auto-correlation operation of the speech/sound signal;

an encoder that encodes the speech/sound signal divided into subframes using one of the frame energy and the subframe energy, and generates encoded speech/sound information; and a transmitter that transmits the encoded speech/sound information over a communication channel to a decoding apparatus, wherein the coding apparatus performs auto-correlation operations that substantially reduce processing calculations without causing deterioration of the accuracy of the frame energy and the subframe energy, wherein, when performing an auto-correlation operation on the speech/sound signal using equation 1 or equation 2, the energy processor performs auto-correlation operations at j' and m' which are different from j and m in accordance with the values of j and m, and calculates one of the frame energy and the subframe energy by substituting the auto-correlation operations at j and m with the auto-correlation operations at j' and m':

(Equation 1)

$$E_k = \sum_i A_i^2 = \sum_{j=0}^{P-1} \sum_{m=0}^{P-1} \alpha_j \alpha_m \sum_i x_{i-j} x_{i-m} \quad [1]$$

$$(i = start_k, \ldots, end_k \quad k = 0, \ldots, N_S - 1)$$

$E_k$: energy (subframe energy) of subframe whose subframe index is k,
$A_i$: speech/sound signal after filtering,
P: filter order,
$\alpha_j$, αm: filter coefficient,
$x_n$: (n+1)-th speech/sound signal of subframe,
j, m: index indicating delay time when auto-correlation is calculated,
i: sample index of speech/sound signal,
$N_s$: number of subframes,
k: subframe index,
$start_k$: leading sample index of subframe whose subframe index is k, and
$end_k$: tail-end sample index of subframe whose subframe index is k; and (Equation 2)

$$E = \sum_i A_i^2 = \sum_{j=0}^{P-1} \sum_{m=0}^{P-1} \alpha_j \alpha_m \sum_i x_{i-j} x_{i-m} \quad [2]$$

$$(i = \text{start}, \ldots, \text{end})$$

E: frame energy,
$A_i$: speech/sound signal after filtering,
P: filter order,
$\alpha_j$, αm: filter coefficient,
$x_n$: (n+1)-th speech/sound signal of frame,
j, m: index indicating delay time when auto-correlation is calculated,
i: sample index of speech/sound signal,
start: leading sample index of frame, and
end: tail-end sample index of frame, and
wherein the energy processor performs control so as to increase the number of combinations of j and m to be substituted with auto-correlation operations at j' and m' as the difference between j and m in equation 1 or equation 2 increases.

2. The coding apparatus according to claim 1, wherein the energy processor substitutes the auto-correlation operations at j and m including a sample in which the amplitude of the speech/sound signal is equal to or greater than a threshold with the auto-correlation operations at j' and m' including a sample in which the amplitude of the speech/sound signal is equal to or greater than the threshold.

3. The coding apparatus according to claim 1, wherein the energy processor sets, as a division point, a point having a maximum variation of an auto-correlation value for each sample for a range in which an auto-correlation operation is performed and substitutes the auto-correlation operations at j and m with the auto-correlation operations at j' and m' before and after the division point.

4. The coding apparatus according to claim 1, wherein, when the variation in the amplitude of the sample within a frame or subframe is large, the energy processor substitutes the auto-correlation operations at j and m with auto-correlation operations at j' and m' including a sample with small amplitude.

5. The coding apparatus according to claim 1, wherein the energy processor substitutes the auto-correlation operations at j and m with the auto-correlation operations at one combination of j' and m' whose difference is equal to the difference between j and m.

6. A communication terminal apparatus, comprising the coding apparatus according to claim 1.

7. A base station apparatus comprising, the coding apparatus according to claim 1.

8. A coding method comprising:

receiving, by a receiver, a speech/sound signal;

dividing, by an energy processor, the speech/sound signal into subframes;

calculating, by the energy processor, one of frame energy and subframe energy of a speech/sound signal using an auto-correlation operations of the speech/sound signal;

encoding, by an encoder, the speech/sound signal divided into subframes using one of the frame energy and the subframe energy, and generating speech/sound encoded information; and transmitting, by a transmitter, the encoded speech/sound information over a communication channel to a decoding apparatus, wherein the coding method performs auto-correlation operations that substantially reduce processing calculations without causing deterioration of the accuracy of the frame energy and the subframe energy, wherein in the calculating, when performing an auto-correlation operation on the speech/sound signal using equation 1 or equation 2, auto-correlation operations at j' and m' which are different from j and m in accordance with the values of j and m are performed, and one of the frame energy and the subframe energy is calculated by substituting the auto-correlation operations at j and m with the auto-correlation operations at j' and m':

(Equation 1)

$$E_k = \sum_i A_i^2 = \sum_{j=0}^{P-1} \sum_{m=0}^{P-1} \alpha_j \alpha_m \sum_i x_{i-j} x_{i-m} \quad [1]$$

$$(i = start_k, \ldots, end_k \quad k = 0, \ldots, N_S - 1)$$

$E_k$: energy (subframe energy) of subframe whose subframe index is k, $A_i$: speech/sound signal after filtering, P: filter order, $\alpha_j$, $\alpha_m$: filter coefficient, $x_n$: (n+1)-th speech/sound signal of subframe, j, m: index indicating delay time when auto-correlation is calculated, i: sample index of speech/sound signal, $N_s$: number of subframes, k: subframe index, $start_k$: leading sample index of subframe whose subframe index is k, and $end_k$: tail-end sample index of subframe whose subframe index is k; and (Equation 2)

$$E = \sum_i A_i^2 = \sum_{j=0}^{P-1} \sum_{m=0}^{P-1} \alpha_j \alpha_m \sum_i x_{i-j} x_{i-m} \quad [2]$$

$$(i = \text{start}, \ldots, \text{end})$$

E: frame energy, $A_i$: speech/sound signal after filtering,

P: filter order, $\alpha_j$, $\alpha_m$: filter coefficient, $x_n$: (n+1)-th speech/sound signal of frame, j, m: index indicating delay time when auto-correlation is calculated, i: sample index of speech/sound signal, start: leading sample index of frame, and end: tail-end sample index of frame, and wherein, in the calculating, control is performed so as to increase the number of combinations of j and m to be substituted with auto-correlation operations at j' and m' as the difference between j and m in equation 1 or equation 2 increases.

* * * * *